United States Patent [19]

Carlson et al.

[11] Patent Number: 4,892,215

[45] Date of Patent: Jan. 9, 1990

[54] BOTTOM CLOSURE FOR A BEVERAGE CONTAINER SLEEVE

[75] Inventors: Robert W. Carlson, Belton; Douglas J. Ham, Austin, both of Tex.

[73] Assignee: Custom Printing, Inc., Austin, Tex.

[21] Appl. No.: 311,870

[22] Filed: Feb. 17, 1989

[51] Int. Cl.[4] ..... B65D 25/24

[52] U.S. Cl. ..... 220/69; 220/85 K; 215/100.5

[58] Field of Search ..... 220/69, 67, 85 K, 85 H; 215/100.5

[56] References Cited

U.S. PATENT DOCUMENTS

| | | | |
|---|---|---|---|
| 2,936,926 | 5/1960 | Miller | 220/69 X |
| 3,419,240 | 12/1968 | Santic | 220/69 |
| 4,733,790 | 3/1988 | Stein | 220/69 X |

*Primary Examiner*—Donald F. Norton
*Attorney, Agent, or Firm*—Walter C. Farley

[57] ABSTRACT

A bottom closure for a beverage container sleeve is made of a soft, flexible polyvinyl chloride and has a short cylindrical sidewall dimensioned to receive the end of an insulating sleeve. The bottom edge of the sidewall is continuously connected to the outer periphery of an annular bottom ring which has a width significantly greater than the radial thickness of the sleeve. A central bottom disk is connected to the inner periphery of the annular ring by a sloping wall, the central disk having openings there through to prevent the formation of an over or under pressure condition within the sleeve when a beverage container is inserted into or extracted therefrom.

2 Claims, 1 Drawing Sheet

BOTTOM CLOSURE FOR A BEVERAGE CONTAINER SLEEVE

This invention relates to a body for forming an improved closure for a beverage container sleeve.

BACKGROUND OF THE INVENTION

It is common practice today to place a beverage container, such as a soft drink or beer can, into a sleeve of foamed polystyrene or the like for the purpose of insulating the beverage container, particularly in warm climates, and also to make the container easier to hold. Additionally, the sleeve can absorb condensation which might form on the can, tending to protect surfaces on which the sleeve containing the beverage container might be placed.

Whether the sleeve is made of a rigid polystyrene foam or a relatively soft, pliable polyurethane foam, the sleeve amounts to little more than a tubular length of thermally insulating material with exposed end edges. Particularly if the sleeve is made of a substantially rigid polystyrene foam, the sleeve is commonly provided with end members to keep the foam intact and to add strength to the overall structure. At the bottom of the sleeve, the end member can constitute a closure for the bottom end of the sleeve to prevent the beverage container from slipping out through the bottom and to also perform a protective function.

However, the bottom closure members which have been provided in the past have numerous disadvantages in that they frequently conduct moisture to the surface on which the sleeve and beverage container is placed and often forms a vacuum within the sleeve so that it is difficult to extract an empty container from the sleeve. Some such closures are slippery and allow the sleeve to slide on a table surface. Additionally, moisture often collects in the bottom of the sleeve. As to assembly, previously used closures have relatively small space for attachment to the tubular portion of the sleeve, and are relatively difficult to assemble because the closure must be positioned and held while being glued together.

SUMMARY OF THE INVENTION

An object of the present invention is to provide an improved bottom closure for a beverage container sleeve which overcomes the disadvantages of the prior art and provides a structurally and functionally superior assembly.

Briefly described, the invention includes a bottom closure for a beverage container sleeve, the sleeve being of the type comprising a tubular length of thermally insulating material dimensioned to receive a beverage container therein, the closure comprising a unitarily formed body of soft, resilient polyvinyl chloride having a short cylindrical sidewall having an inner surface dimensioned to receive therein an end portion of a beverage container sleeve. An annular, generally planar bottom ring having a radial width significantly greater than the radial thickness of the beverage container sleeve has its outer periphery substantially continuously connected to an end of the cylindrical sidewall. A central bottom disk for receiving and supporting a beverage container inserted into the sleeve has a downwardly and outwardly sloping wall joining the outer periphery of the central disk to the inner periphery of the ring. A plurality of openings extend through the central disk.

BRIEF DESCRIPTION OF THE DRAWINGS

In order to impart full understanding of the manner in which these and other objects are attained in accordance with the invention, a particularly advantageous embodiment thereof will be described with reference to the accompanying drawings, which form a part of the specification, and wherein.

DESCRIPTION OF THE PREFERRED EMBODIMENT

Figure 1:
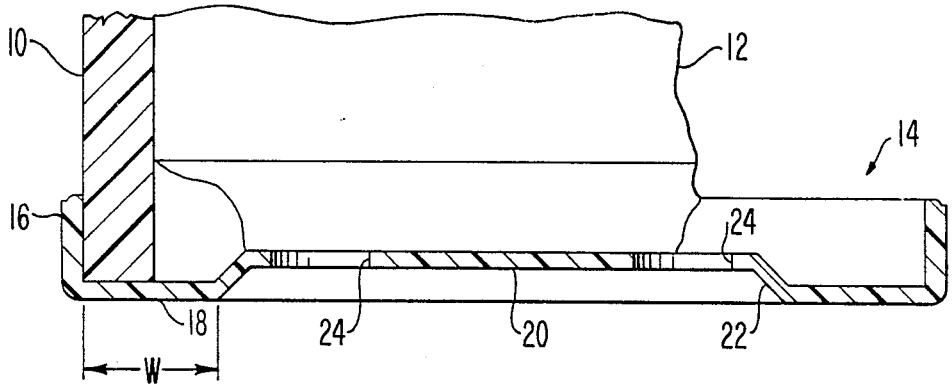
FIG. 1 is a partial side elevation, in section, of a sleeve and bottom closure in accordance with the present invention.
Figure 2:
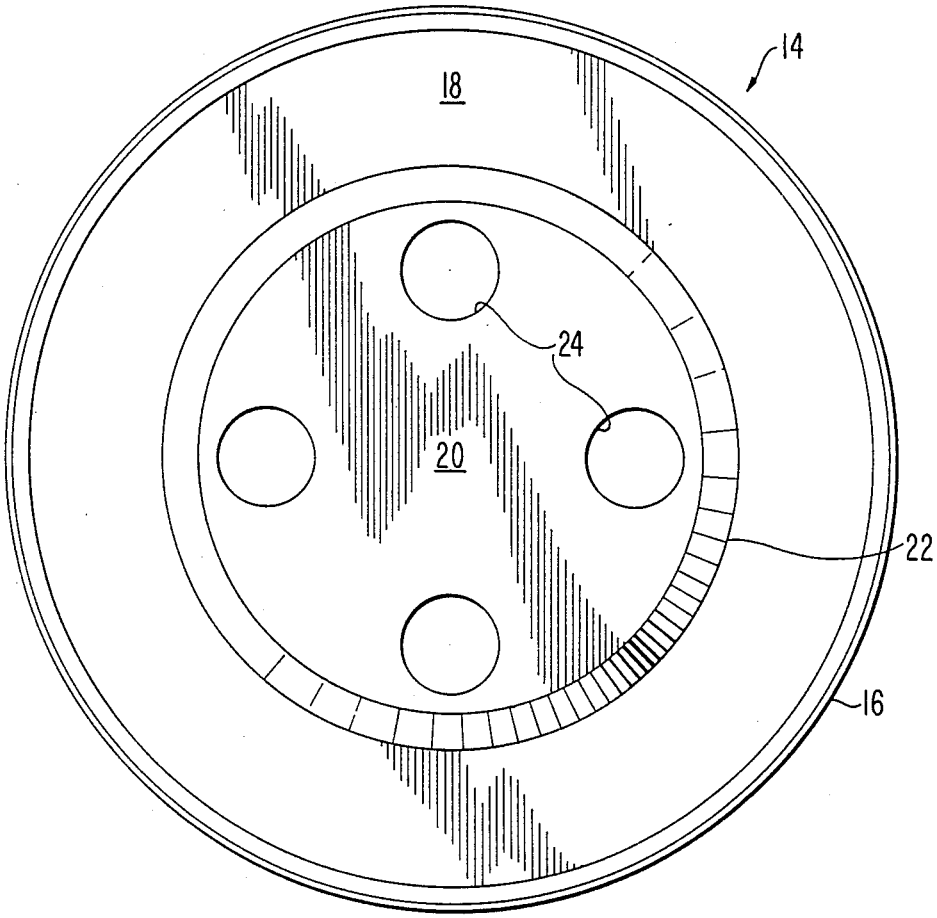
FIG. 2 is a top plan view of the bottom closure of FIG. 1.
Figure 3:
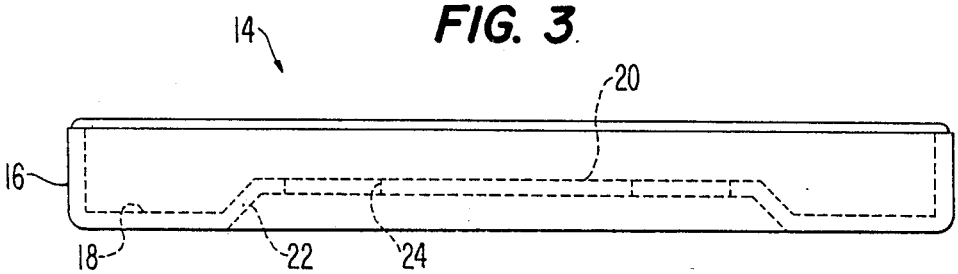
FIG. 3 is a side elevation of the bottom closure of FIG. 2.

FIG. 1 illustrates a portion of a beverage container sleeve 10 in which a beverage container 12 is inserted. The bottom of the sleeve 10 is closed by a sleeve closure in accordance with the invention indicated generally at 14. Because the sleeve 10 and beverage container 12 are notoriously old in the art, they are only partially shown and will be described only to a minimal extent. The sleeve 10, as indicated in the figure, is a generally tubular body having a length approximating the height of a beverage container and having a thickness which is sufficient to insulate the sidewalls of the container from a considerable amount of heat exchange with the environment and yet be convenient to hold in one's hand. Foamed polystyrene, polyurethane and other materials can be used to make the sleeve itself. The shape of the beverage container is, of course, fairly standard, with minor variations, and can be rather snugly received within the sleeve. The top rim of the sleeve can be provided with a protective ring or the like, but this is not part of the present invention and will not be further discussed.

Of particular interest is the bottom closure 14 which comprises a unitarily formed body of soft, flexible polyvinyl chloride preferably having a durometer hardness of about 55. The body is formed with a short cylindrical sidewall 16, the inner surface of which has a diameter selected to receive the end of sleeve 10 with a rather snug fit. An annular generally planar bottom ring 18 is substantially continuously connected at its outer periphery to the bottom edge of wall 16 so that the inner surface of ring 18 is abutted by the lower end of sleeve 10. As shown in FIG. 1, the radial width W of ring 18 is significantly greater than the radial thickness of sleeve 10.

Within ring 18 is a central bottom disk 20 which supports the bottom end of container 12, the diameter of disk portion 20 being about the same as, or smaller than, the bottom of container 12. At the outer periphery of disk 20 is a downwardly and outwardly sloping wall 22 which joins the outer periphery of the central disk to the inner periphery of the bottom ring 18.

Disk 20 is provided with holes 24 which extend completely through the disk.

The additional width of ring portion 18, together with the sloping portion 22, defines a moisture receiving cavity inside the sleeve which can receive any excess moisture not absorbed or prevented the sleeve itself, keeping that moisture from spilling over onto surfaces on which the sleeve might be placed. The provision of openings 24 permits easier insertion of and extraction of container 12 from the sleeve, preventing the formation of a vacuum or over-pressure condition.

The material from which the bottom closure is made, the soft polyvinyl chloride, is a flexible material which, when detached from the sleeve, can be bent and folded easily and has a rubbery, soft feel. These characteristics of the polyvinyl chloride from which the closure is made allows it to resist skidding or slipping on table surfaces. Additionally, the material facilitates assembly, not only because the sidewall 16 can be temporarily deformed to place it around the end of sleeve 10 but also because an adhesive can be placed on the inner surfaces of wall 16 and also ring 18 and the sleeve can be inserted without any special positioning or holding equipment. The assembly thus formed can simply be set aside to dry or cure. Furthermore, the adherence is considerably greater because of the axial, concentric relationship between wall 16 and sleeve 10. Still further, the sidewall 16 of the sleeve is visible in the final product and, with suitable coloration, can be made to be an attractive, decorative feature of the assembly. It is also considerably more durable than prior closures.

Closure 14 is preferably formed by injection molding, the material being readily purchased in bead form. Following injection molding, no further steps are necessary to prepare the closure for assembly to the sleeve.

While one advantageous embodiment has been chosen to illustrate the invention, it will be understood by those skilled in the art that various changes and modifications can be made therein without departing from the scope of the invention as defined in the appended claims.

What is claimed is:

1. A bottom closure for a beverage container sleeve, the sleeve being of the type comprising a tubular length of thermally insulating material dimensioned to receive a beverage container therein, the closure comprising a unitarily formed body of soft, flexible polyvinyl chloride having a short cylindrical having an inner surface dimensioned to receive therein an end portion of a beverage container sleeve;

an annular, generally planar bottom ring having a radial width significantly greater than the radial thickness of said beverage container sleeve, the outer periphery of said bottom ring being substantially continuously connected to an end of said cylindrical side wall;

a central bottom disk for receiving and supporting a beverage container inserted into said sleeve, said disk having a downwardly and outwardly sloping wall joining the outer periphery of said central disk to the inner periphery of said ring; and means defining a plurality of openings through said central disk.

2. A closure according to claim 1 wherein said body has a durometer hardness of about 55.

* * * * *